US009512554B2

(12) United States Patent
Baurmann et al.

(10) Patent No.: US 9,512,554 B2
(45) Date of Patent: Dec. 6, 2016

(54) DEVICE FOR CLEANING A COMPONENT, IN PARTICULAR AN EVAPORATOR OF A CONDENSER DEVICE

(75) Inventors: Martin Baurmann, Berlin (DE); Frank Kohlrusch, Berlin (DE); Günter Steffens, Dallgow-Döberitz (DE); Oliver Wuttge, Hofheim (DE)

(73) Assignee: BSH HAUSGERÄTE GMBH, Munich (DE)

( * ) Notice: Subject to any disclaimer, the term of this patent is extended or adjusted under 35 U.S.C. 154(b) by 324 days.

(21) Appl. No.: 13/002,787

(22) PCT Filed: Jul. 9, 2009

(86) PCT No.: PCT/EP2009/058731
§ 371 (c)(1),
(2), (4) Date: Jan. 6, 2011

(87) PCT Pub. No.: WO2010/003999
PCT Pub. Date: Jan. 14, 2010

(65) Prior Publication Data

US 2011/0114135 A1 May 19, 2011

(30) Foreign Application Priority Data

Jul. 11, 2008 (DE) ..... 10 2008 032 800

(51) Int. Cl.
*D06F 58/24* (2006.01)
*D06F 58/20* (2006.01)

(52) U.S. Cl.
CPC ..... *D06F 58/20* (2013.01); *D06F 58/24* (2013.01)

(58) Field of Classification Search
CPC ..... D06F 58/24; D06F 58/20; E03D 5/02; E03D 5/022; E03D 5/092; F16K 1/20; F16K 1/2007; F16K 1/18; B65D 90/623
(Continued)

(56) References Cited

U.S. PATENT DOCUMENTS 1,526,101 A 2/1925 Sund
1,626,969 A 5/1927 Reeves
(Continued)

FOREIGN PATENT DOCUMENTS

CN 1609326 4/2005
DE 2256404 B1 7/1973
(Continued)

OTHER PUBLICATIONS

DE3738031—Machine Translation.*
(Continued)

*Primary Examiner* — Michael Kornakov
*Assistant Examiner* — Marc Lorenzi
(74) *Attorney, Agent, or Firm* — Nixon & Vanderhye, P.C.

(57) ABSTRACT

A device that has a component within a process air circuit of a washer dryer or tumble dryer; a condensate water trough in which condensate water is collected that is formed in the process air circuit as a result of drying damp laundry; and a first lever arm rotatably fastened to a rinse tank above the component. The component is to be cleaned and the condensate water is conducted from the condensate water trough to the rinse tank. Further, the condensate water is dispensed from an outlet opening of the rinse tank to the component. The rinse tank has a closure to selectively open and close the outlet opening and an actuator to actuate the closure. Also, the closure has a sealing head that is con-
(Continued)

nected to the first lever arm and that closes the outlet opening.

36 Claims, 10 Drawing Sheets

(58) Field of Classification Search
USPC ..... 137/315.37; 251/231, 242, 243
See application file for complete search history.

(56) References Cited

U.S. PATENT DOCUMENTS

| | | | | | |
|---|---|---|---|---|---|
| 2,587,994 | A | | 12/1951 | Dunaway | |
| 2,742,708 | A | | 4/1956 | McCormick | |
| 2,771,228 | A | * | 11/1956 | Dobbie et al. | 222/481.5 |
| 2,843,943 | A | | 7/1958 | Geldhof et al. | |
| 3,072,129 | A | | 1/1963 | Seal | |
| 3,083,557 | A | | 4/1963 | Decatur | |
| 3,103,112 | A | | 9/1963 | Behrens et al. | |
| 3,268,202 | A | * | 8/1966 | Murray et al. | 251/86 |
| 3,572,553 | A | * | 3/1971 | Ogden | 222/67 |
| 3,650,281 | A | | 3/1972 | Hurst | |
| 3,910,499 | A | | 10/1975 | Trouilhet | |
| 3,940,861 | A | | 3/1976 | Frazar | |
| 4,069,521 | A | * | 1/1978 | Aleman | 4/300 |
| 4,345,343 | A | | 8/1982 | Shipman | |
| 4,635,824 | A | | 1/1987 | Gaunt et al. | |
| 4,653,200 | A | | 3/1987 | Werner | |
| 4,678,892 | A | | 7/1987 | Finger et al. | |
| 4,743,933 | A | * | 5/1988 | Rentschler | 396/169 |
| 4,891,892 | A | | 1/1990 | Narang | |
| 5,050,259 | A | | 9/1991 | Tsubaki et al. | |
| 5,104,165 | A | * | 4/1992 | Anderson et al. | 292/337 |
| 5,148,768 | A | | 9/1992 | Hinton | |
| 5,226,203 | A | | 7/1993 | Sacconato et al. | |
| 5,272,781 | A | | 12/1993 | Bastin et al. | |
| 5,345,957 | A | | 9/1994 | Cooper et al. | |
| 5,505,593 | A | | 4/1996 | Hartley et al. | |
| 5,706,588 | A | | 1/1998 | Dausch et al. | |
| 5,719,553 | A | * | 2/1998 | Lamparter | 340/433 |
| 6,042,028 | A | | 3/2000 | Xu | |
| 6,308,760 | B1 | * | 10/2001 | Finzo et al. | 156/494 |
| 7,213,349 | B1 | | 5/2007 | Brunner | |
| 7,251,905 | B2 | | 8/2007 | Doh et al. | |
| 7,412,853 | B2 | | 8/2008 | Hong et al. | |
| 8,266,814 | B2 | | 9/2012 | Grunert et al. | |
| 2002/0145008 | A1 | * | 10/2002 | Jones et al. | 222/146.5 |
| 2003/0029705 | A1 | | 2/2003 | Qiu et al. | |
| 2004/0162149 | A1 | * | 8/2004 | Bayer et al. | 464/162 |
| 2005/0066538 | A1 | | 3/2005 | Goldberg et al. | |
| 2005/0132593 | A1 | | 6/2005 | Doh et al. | |
| 2006/0125284 | A1 | * | 6/2006 | Kristl | 296/146.11 |
| 2006/0145793 | A1 | | 7/2006 | Ning et al. | |
| 2006/0151054 | A1 | | 7/2006 | Deaton | |
| 2006/0159519 | A1 | | 7/2006 | Schluter et al. | |
| 2006/0179676 | A1 | | 8/2006 | Goldberg et al. | |
| 2007/0113327 | A1 | | 5/2007 | Denkewicz, Jr. et al. | |
| 2008/0068772 | A1 | * | 3/2008 | Kubo et al. | 361/159 |
| 2009/0320312 | A1 | | 12/2009 | Azpilicueta | |
| 2010/0065087 | A1 | | 3/2010 | Grunert | |
| 2010/0101606 | A1 | | 4/2010 | Grunert | |
| 2010/0212369 | A1 | | 8/2010 | Grunert et al. | |
| 2010/0243002 | A1 | | 9/2010 | Grunert et al. | |
| 2010/0257669 | A1 | | 10/2010 | Kennedy et al. | |
| 2011/0302967 | A1 | | 12/2011 | Grunert et al. | |

FOREIGN PATENT DOCUMENTS

| | | | | | |
|---|---|---|---|---|---|
| DE | 2702639 | | | 7/1978 | |
| DE | 2702639 | A1 | | 7/1978 | |
| DE | 2933513 | A1 | | 3/1981 | |
| DE | 3321245 | | | 12/1984 | |
| DE | 3738031 | A1 | * | 5/1989 | |
| DE | 4212965 | A1 | | 10/1993 | |
| DE | 4303655 | | | 8/1994 | |
| DE | 4333901 | | | 2/1995 | |
| DE | 3738031 | C2 | | 10/1995 | |
| DE | 19600489 | | | 7/1996 | |
| DE | 19511344 | | | 10/1996 | |
| DE | 19639331 | | | 3/1998 | |
| DE | 19701225 | A1 | | 7/1998 | |
| DE | 19943125 | A1 | * | 11/2000 | D06F 58/24 |
| DE | 10002742 | | | 6/2001 | |
| DE | 10002743 | | | 8/2001 | |
| DE | 102005014842 | | | 5/2006 | |
| DE | 102006006080 | | | 8/2007 | |
| DE | 102006006080 | A1 | | 8/2007 | |
| DE | 102006018469 | | | 10/2007 | |
| DE | 102006018469 | A1 | | 10/2007 | |
| DE | 102007016074 | A1 | | 10/2008 | |
| DE | WO2008119611 | A1 | | 10/2008 | |
| EP | 430664 | A1 | * | 6/1991 | |
| EP | 0468573 | A1 | | 1/1992 | |
| EP | 0548386 | | | 6/1993 | |
| EP | 0731203 | A1 | | 9/1996 | |
| EP | 0731204 | | | 9/1996 | |
| EP | 0740012 | A1 | | 10/1996 | |
| EP | 0816549 | | | 1/1998 | |
| EP | 1055767 | A1 | | 11/2000 | |
| EP | 1098028 | | | 7/2004 | |
| EP | 1936022 | A1 | | 6/2008 | |
| FR | 2664625 | | | 1/1992 | |
| FR | 2711153 | | | 4/1995 | |
| GB | 2115127 | A1 | | 9/1983 | |
| KR | 2002031581 | A | | 5/2002 | |
| WO | WO 2007062905 | | | 6/2007 | |
| WO | WO 2007062905 | A1 | * | 6/2007 | F16K 31/52 |
| WO | 2008067352 | A2 | | 6/2008 | |
| WO | WO 2008119611 | | | 10/2008 | |
| WO | WO 2009/095312 | | | 8/2009 | |

OTHER PUBLICATIONS

Roemheld, "Betriebsanleitung Schnellverschlusskupplungen," www.roemheld.de, Jan. 2004.
Final Office Action issued in corresponding U.S. Appl. No. 12/682,283 issued Jun. 9, 2014.
Report of Examination of European Application No. 201070558.
National Search Report CN 201080011890.6.
International Search Report PCT/EP2010/052082.
National Search Report DE 10 2009 001 548.
Office Action issued in corresponding U.S. Appl. No. 12/682,283 dated Sep. 26, 2014.
Office Action issued in corresponding U.S. Appl. No. 13/256,474 dated Sep. 17, 2014.
Office Action issued in corresponding U.S. Appl. No. 13/203,262 dated Aug. 21, 2014.
Office Action issued in U.S. Appl. No. 12/532,203, dated Feb. 13, 2015, (52 pages).
Office Action issued in U.S. Appl. No. 13/256,474, dated Mar. 5, 2015, (20 pages).
Office Action issued in U.S. Appl. No. 12/532,203, dated Jun. 30, 2015, (26 pages).
Office Action (Examiner's Answer to Appeal Brief) issued in U.S. Appl. No. 13/256,474, dated Nov. 19, 2015 (25 pages).
Office Action (Non-Final Rejection) issued in U.S. Appl. No. 12/682,283, dated Nov. 10, 2015 (51 pages).
Office Action (Non-Final Rejection) issued in U.S. Appl. No. 12/532,203, dated Dec. 16, 2015 (17 pages).
Report of Examination of Eurasian Application No. 201070558, dated Jan. 23, 2013 (2 pages).
National Search Report CN 201080011890.6, dated Jan. 25, 2013 (1 page).
International Search Report PCT/EP2010/052082, dated Sep. 16, 2010 (3 pages).
National Search Report DE 10 2009 001 548, dated Jan. 26, 2010 (3 pages).
Roemheld, "Quick-Disconnect Coupling," www.roemheld.com, issue 11-08 E.

(56) References Cited

OTHER PUBLICATIONS

Roemheld, "Betriebsanlietung Schnellverschlusskupplungen," www.roemheld. Jan. 2004.
U.S. Office Action (Notice of Allowance and Notice of Allowability) issued in U.S. Appl. No. 12/682,283, mailed Mar. 29, 2016 (27 pages), (including PTO-892 citing Heagerty, U.S. Pat. No. 2,660,396, issued Nov. 24, 1953; Behrens, U.S. Pat. No. 3,162,032, issued Dec. 22, 1964; Goto, U.S. Pat. No. 3,768,514, issued Oct. 30, 1973; Rigby et al., U.S. Pat. No. 5,193,562, issued Mar. 16, 1993).

* cited by examiner

DEVICE FOR CLEANING A COMPONENT, IN PARTICULAR AN EVAPORATOR OF A CONDENSER DEVICE

This application is a U.S. National Phase of International Patent Application No. PCT/EP2009/058731, filed Jul. 9, 2009, which designates the U.S. and claims priority to German Patent Application No. DE 10 2008 032 800.6, filed Jul. 11, 2008, the entire contents of each of which are hereby incorporated by reference.

BACKGROUND OF THE INVENTION

The invention relates to a device with a component to be cleaned that is disposed within a process air circuit of a washer dryer or tumble dryer, in particular an evaporator of a condenser device, and with a condensate water trough, in which condensate water formed in the process air circuit as a result of the drying of damp laundry can be collected, conducted from this to a rinse tank provided above the evaporator and dispensed from this out of an outlet opening to the component to be cleaned. The invention also relates to a method for operating such a device.

A method and a device of the type mentioned above are already known for removing lint from a condensed water separator configured as a heat exchanger (DE 37 38 031 C2). With the known method in question and the device provided to implement it a relatively small quantity of around half a liter of condensed water is used for a single rinsing operation for the plates of the condenser device provided. The rinsing process in question here takes around 30 seconds. To actively remove lint that remains suspended in the condenser device when damp laundry is dried from the condenser device in question, the condenser device has to be rinsed relatively thoroughly. This requires the use of a relatively powerful pump, which pumps the condensate water out of the condensate water trough to the rinsing device present. However there is sometimes a wish to avoid such a major outlay and manage with a simpler arrangement, to clean a component disposed within a process air circuit of a washer dryer or tumble dryer, in particular an evaporator of a condenser device, using the condensate water collected in a condensate water trough.

A device for cleaning the evaporator of a condenser device in a tumble dryer is also known (EP 0 468 573 A1). With this known device the evaporator of the condenser device, which consists of a plurality of fins disposed parallel to one another, can be cleaned on its side opposite a condensate water trough by means of a cleaning device. This cleaning device consists of a comb-type brush or bristle arrangement that can be moved to and fro and to which condensate water contained in the condensate water trough can also be supplied. However with this known device the evaporator of the condenser device is cleaned relatively inadequately, as the comb-type cleaning device is only able to clean the upper region of the evaporator of the condenser device but not the much larger region below it. This could possibly be cleaned, if the comb-type cleaning device were provided with bristles extending over the entire depth of the evaporator. However this would require a relatively high energy outlay and therefore a relatively high outlay in respect of equipment due to the associated significant friction between the bristles of the comb-type cleaning device and the side walls of the fins of the evaporator, if it were to function at all. Such an outlay is however considered to be undesirable.

A method and a household tumble dryer for cleaning a section of a guide of a process air flow are also known (DE 199 43 125 A1). Here a blower is provided to generate the process air flow, which can be brought into contact with the laundry to be dried in order to absorb moisture in a drying compartment. Outside a drying phase in which the process air flow is generated by means of the blower and brought into contact with the laundry to be dried in the drying compartment, in a cleaning phase with the blower switched off at least part of a section of the process air guide is flooded with liquid for a defined time period. At the end of the cleaning phase this liquid is again removed from the flooded section of the process air guide. The liquid in question is in particular condensate liquid from a condensate tank in which condensate water from the drying of damp laundry collects as the laundry is dried. In order to be able to achieve the abovementioned flooding of the abovementioned one section of the process air guide, said section should be sealed off by means of a sealing arrangement, which is however sometimes considered to be undesirable due to the associated outlay. A simpler solution is therefore sought for cleaning a component disposed within a process air circuit of a washer dryer or tumble dryer.

BRIEF SUMMARY OF THE INVENTION

The object of the invention is therefore to show how a component disposed within a process air circuit of a washer dryer or tumble dryer, in particular an evaporator of a condenser device, can be cleaned in a particularly simple manner with rinse water even more efficiently than was previously known or suggested without any appreciable outlay being required for the purpose.

The object is achieved by means of a device and a method as claimed in the respective independent claims. Advantageous embodiments will emerge from the dependent claims in particular.

The device is provided with a component to be cleaned within a process air circuit of a washer dryer or tumble dryer, in particular an evaporator of a condenser device, and with a condensate water trough, in which condensate water formed in the process air circuit as a result of the drying of damp laundry can be collected, conducted from this to a rinse tank provided above the evaporator and dispensed from this out of an outlet opening to the component to be cleaned.

The rinse tank has a closure part for selectively opening and closing off the outlet opening and an actuator for actuating the closure part. The closure part features a sealing head for closing off the outlet opening, said sealing head being connected to a first lever arm fastened rotatably to the rinse tank.

The invention has the advantage that the use of the lever arm means that any movement of the sealing head can be adjusted very flexibly to attributes of an actuator moving the closure part. It is thus possible to correlate the force/lift characteristic curve of the actuator with the effective force arm to achieve adequate lift with a sufficiently fast opening movement. Fast switching actuators can in particular therefore be used, which however in some instances can only produce a small force with larger lifts or only feature a small lift. It is therefore possible to generate a surge of water particularly effectively to clean the component to be cleaned. Also no complicated force transmission means have to be used between the actuator and the sealing head, with the result that the structure is economical and requires little repair work.

Such a fast switching valve or closure part with high lift therefore allows the dispensing of the condensate water from the rinse tank in the manner of a surge, in some instances with the additional dispensing of pressurized mains water to the relevant component to be generated particularly effectively, in order to be able to clean a component disposed within a process air circuit of a washer dryer or tumble dryer, in particular an evaporator of a condenser device, more efficiently than was previously known and previously suggested, particularly of lint that has accumulated there during the process of drying damp laundry. If we assume for example a condensate water quantity of 2.5 liters that has collected in the rinse tank, efficient cleaning of the component or evaporator of the condenser device is achieved by dispensing this quantity of condensate water in a surge within a time interval of around 1 second to 2 seconds. If 2.5 liters of condensate water is dispensed within 1 second, this corresponds to a dispensed quantity of 150 liters/minute condensate water. If the condensate water is dispensed within 2 seconds as assumed by way of example, this corresponds to the dispensing of condensate water at a rate of 75 liters/minute. Such quantities of water could—if a pump were to be used to dispense them—only be dispensed with a relatively large-volume and powerful feed pump, the use of which could not however be considered in washer dryers or tumble dryers for feeding in condensate water to clean components disposed there within process air circuits, particularly evaporators of condenser devices. The additional dispensing of pressurized mains water to the component to be cleaned allows even more efficient cleaning of the relevant component to be cleaned at a typical mains water pressure of 3 bar for example.

The actuator for actuating the closure part is preferably set up and disposed to apply a force (force component or torque) to the first lever arm.

The actuator is preferably a fast switching actuator to release an outlet opening quickly, in order to configure the surge of water to the component to be cleaned effectively. The actuator particularly preferably features a lifting magnet, as a lifting magnet can switch quickly and is compact and cost-effective. However the invention is not limited thereto; a piezo electric actuator, a magnetostrictive actuator, a fast moving servo motor, etc. can also be used. It is also possible to use a bistable spring, which can switch by means of a suitable (e.g. electromechanical or thermal) drive to actuate the closure part.

It is also preferable if the lifting path of the actuator required for effective opening of the closure part is traveled through in less than 2 seconds, particularly preferably in less than 0.5 seconds, particularly preferably in less than 0.2 seconds.

A lifting movement of the actuator is preferably applied to the closure part by way of a plunger, as this allows simple and low-maintenance force transmission.

A lifting path of the actuator is preferably maximum 30 mm, in particular maximum 25 mm. The actuator may be provided with a lift amplifier, e.g. with an amplifying mechanical lift transmitter.

The first lever arm is preferably disposed in the rinse tank, as this allows a simple closure part to be realized. The actuator can engage directly with the first lever arm or even the sealing head. To this end the actuator can be provided in the rinse tank or be passed through the rinse tank to the first lever arm or the sealing head.

However the device preferably also has a second lever arm outside the condensate tank, said second lever arm being coupled to the first lever arm, the actuator being set up to actuate the second lever arm. The actuator therefore engages indirectly with the first lever arm. This means that the actuator does not have to be disposed in the rinse tank with the result that it and its electrical connectors do not have to be embodied in a watertight manner and also no useful volume is wasted in the rinse tank. The two levers create a lever system at least for opening purposes, by means of which the lifting magnet applies a force to the second, outer lever arm (serving as the force arm), which is transmitted to the first, inner lever arm (serving as the load arm), the following movement of which causes the sealing head to be lifted from the outlet opening.

The two lever arms are preferably connected to one another by way of a common shaft, which serves as a rotatable bearing.

The first lever arm and the second lever arm are preferably coupled to one another by way of a claw coupling, in particular a coded claw coupling, which is preferably provided in the shaft.

The two levers can be connected to one another in particular by a through opening, in particular a lateral through opening, in the rinse tank. In particular however a through opening does not need to be provided in the base of the rinse tank, as is required for example when using a poppet valve passed through the base.

At least one sealing element is preferably present between the two lever arms, e.g. on the first lever arm or on the second lever arm, to seal off the through opening in order to prevent an unwanted escape of water out of the rinse tank through the through opening.

At least one spring element is preferably also provided to press the closure part onto the outlet opening (return spring) to ensure reliable sealing when the actuator is not activated, e.g. a torsion spring. Other sealing aids can essentially also be used; in addition to a return spring for example an additional weight could also be considered to load the closure part. One advantage of the return spring is however that it closes off the outlet opening irrespective of the position of the rinse tank. The rinse tank can thus be removed from the dryer and be handled by a user without there being a risk of the outlet opening being opened inadvertently.

The rinse tank is preferably removable and the actuator is preferably positioned on a receiving opening holding the rinse tank. This means that the actuator does not have to be removed from the dryer, allowing simple attachment and electrical contacting.

With the method for operating such a device an actuation of the actuator to open the outlet opening causes a force or torque to be applied directly or indirectly to the first lever arm, as a result of which the first lever arm lifts the sealing head off the outlet opening. When the force is applied indirectly to the first lever arm, the actuator engages with a force transmission element that is connected to the first lever arm in such a manner that the force or torque applied directly to the force transmission element is transmitted to the first lever arm. The force transmission element is preferably a second lever arm, which then serves as the force arm, while the first lever arm serves as the load arm. The two lever arms are preferably connected to one another by way of a common shaft that serves as a rotatable bearing, in some instances by way of a coupling, in particular a coded claw coupling.

The condensate water from the rinse tank or a rinse chamber of a collector featuring this and an overflow region serving as a storage chamber is preferably dispensed as rinse water in the manner of a surge of water and/or pressurized mains water due to the sudden opening of said tank or chamber on the outlet side.

It should be noted here that mains water here is used to refer to the mains water available in houses, this normally being supplied at a mains water pressure of at least 3 bar but sometimes at an even higher pressure, for example 6 bar.

The dispensed quantity of the surge of water to be dispensed to the component is preferably largely regularized between the start and end of dispensing. This has the advantage of a relatively regular rinsing action on or in the component to be cleaned between the start and end of the dispensing of the surge of water.

According to a further expedient embodiment of the present invention with an evaporator of a condenser device forming said component the surge of water and in some instances the pressurized mains water are dispensed to an evaporator region preferably located only at a set distance from the inlet region of the process air into the evaporator. This has the advantage that deposits in the form of lint that generally occur to a greater degree over the entire inlet region of the evaporator can be effectively removed. The water here is preferably dispensed immediately after the end of a drying process for damp laundry to be dried, as at this time point impurities, particularly lint, adhering to the abovementioned component or evaporator of the condenser device are still damp and can be removed relatively easily by the dispensed rinse liquid.

According to another expedient development of the present invention with an evaporator of a condenser device forming said component the surge of water and in some instances the pressurized mains water are dispensed subject to mechanical, hydraulic, pneumatic or electromechanical deflection from an initial region provided at the inlet region of the process air into the evaporator to an end region at a distance therefrom in the direction of the outlet region of the process air out of the evaporator. This has the advantage that the component to be cleaned, in particular the evaporator of a condenser device, can be cleaned relatively simply over a definable region. The region in question can extend here from the inlet region of the process air into the evaporator to its outlet region out of the evaporator. In this instance the rinse water is also preferably dispensed immediately after the end of a drying process for damp laundry to be dried, as at this time point impurities, particularly lint, adhering to the abovementioned component or evaporator of the condenser device are still damp and can be removed readily by the rinse liquid dispensed in the manner of a surge.

The condensate water is expediently pumped out of the condensate water trough into the rinse tank or rinse chamber of said collector by means of a pump. This represents a relatively simple option for supplying the condensate water, which is dispensed as a surge of water for cleaning the component formed in particular by an evaporator of a condenser device. A relatively small pump of small capacity is advantageously adequate here to pump the condensate water out of the condensate water trough into the rinse tank. The capacity of such a pump is significantly less, in particular with regard to size, than the capacity of a pump as mentioned in the introduction in relation to the basic embodiment of the present invention.

A device with a component to be cleaned that is disposed within a process air circuit of a washer dryer or tumble dryer, in particular an evaporator of a condenser device, and with a condensate water trough, in which condensate water formed in the process air circuit as a result of the drying of damp laundry can be collected, conducted from this to a rinse tank provided above the evaporator and dispensed from this to the component to be cleaned, preferably serves to implement the method. This device is preferably characterized in that said tank as a rinse tank (or as a rinse chamber of a collector comprising this and an overflow region serving as a storage chamber) features a closure part provided on its outlet side, the sudden opening of which allows the rinse tank or rinse chamber to dispense the condensate water contained therein in a surge through a downpipe to said component and as an alternative or in addition to the dispensing of the condensate water out of the rinse tank or rinse chamber allows a supply pipe carrying pressurized mains water to dispense the mains water in question to said component on the output side.

This has the advantage of a particularly small device outlay for particularly efficient cleaning of a component disposed within a process air circuit of a washer dryer or tumble dryer, in particular of an evaporator of a condenser device. Sudden opening of the rinse tank on its outlet side allows the condensate water that has collected in the rinse tank to be dispensed quickly as a surge of water to the component to be cleaned in an efficient manner without additional devices being required for the purpose. As well as the dispensing of the surge of water to the component to be cleaned, pressurized mains water can also be dispensed to said component for cleaning purposes. Where said component is cleaned additionally by means of pressurized mains water, a particularly intensive cleaning effect can be achieved due to the mains water pressure of normally at least 3 bar.

Said downpipe expediently features a region that is narrower than the cross section of the outlet region of the rinse tank or rinse chamber. This allows good regularization of the dispensing of the surge of water to be achieved between its start and end in a relatively simple manner.

According to a further expedient embodiment of the invention with an evaporator of a condenser device forming said component the surge of water and/or the pressurized mains water can be dispensed to an evaporator region preferably located only at a set distance from the inlet region of the process air into the evaporator by means of a rinse nozzle disposed in a fixed position and connected to the downpipe. This has the advantage of particularly effective cleaning of the region of the evaporator mainly to be cleaned, which the process air enters, depositing impurities such as lint there in particular.

According to another expedient development of the present invention the rinse nozzle and/or the downpipe can be deflected during the dispensing of the surge of water and/or pressurized mains water by a mechanically, hydraulically, pneumatically or electromechanically actuated deflection device from an initial region at the inlet region of the process air into the evaporator of the condenser device to an end region at a distance therefrom in the direction of the outlet region of the process air out of the evaporator. This has the advantage that the evaporator of the condenser device is to be cleaned by said surge of water over a definable length, which can in particular be its entire length, over which process air streams through it.

The rinse tank or rinse chamber is expediently connected to the condensate water trough by means of a pump. This has the advantage that the rinse tank or rinse chamber can be filled with condensate water in a relatively simple manner.

The object is consequently also achieved by means of a laundry dryer, e.g. a washer dryer or tumble dryer, with a device of the type mentioned above. It should be noted here that a washer dryer refers to a combination appliance that has a washing function for washing laundry and a drying function for drying damp laundry. A tumble dryer in contrast only has a drying function for drying damp laundry.

BRIEF DESCRIPTION OF THE DRAWINGS

The present invention is described schematically and by way of example below with reference to the accompanying drawing, in which.

DETAILED DESCRIPTION OF EXEMPLARY EMBODIMENTS OF THE PRESENT INVENTION

Figure 1:
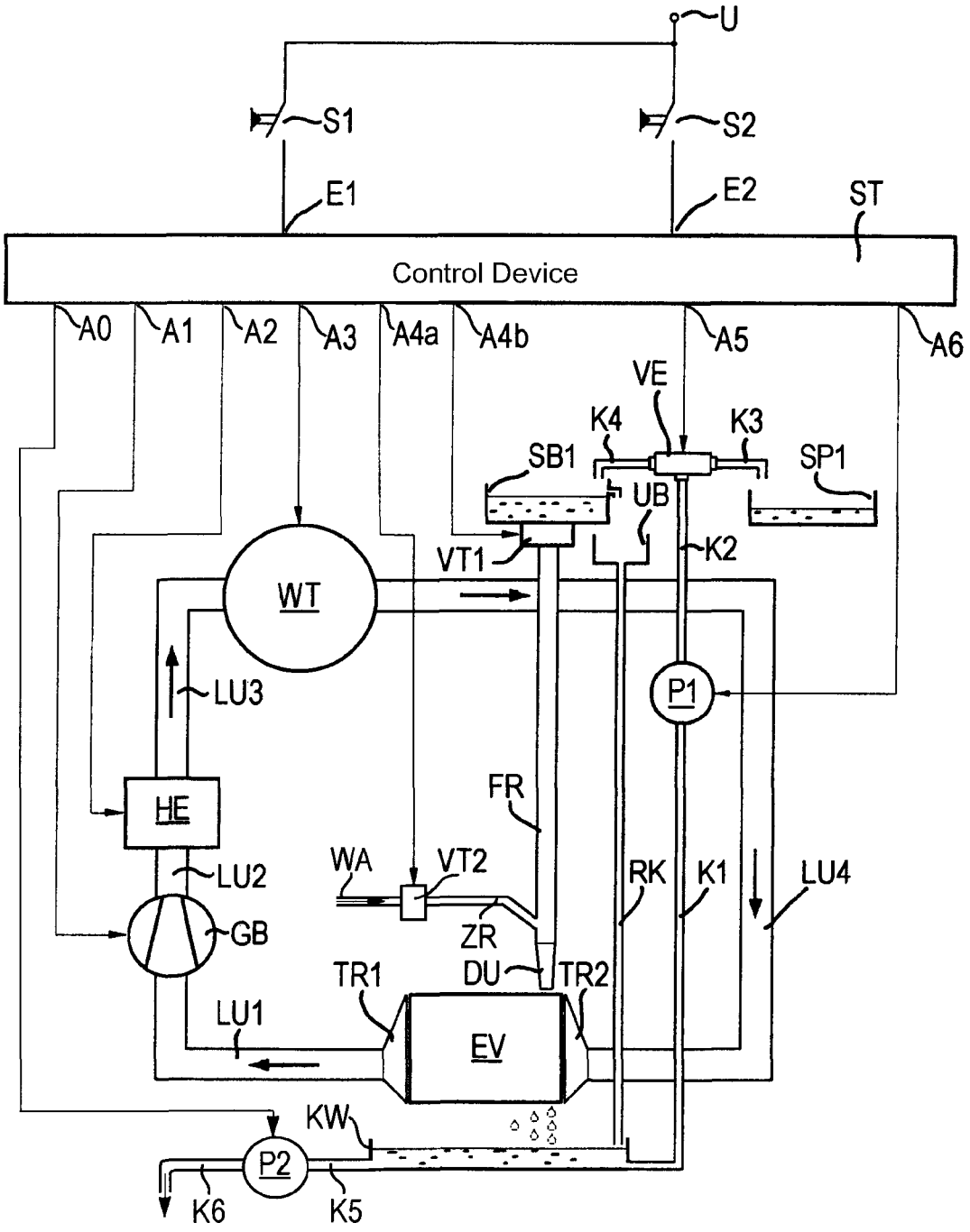
FIG. 1 shows a schematic diagram of a device according to a first embodiment.

Before looking more closely at the drawing, it should be noted that identical elements and devices are shown with identical reference characters in all the figures.

The device according to the first embodiment illustrated in a schematic drawing in FIG. 1 is contained in a washer dryer or tumble dryer of which only the parts the functions of which are essential for an understanding of the present diagram are illustrated in FIG. 1. These parts include primarily a washing or laundry drum WT containing damp laundry to be dried and a process air flow arrangement connected thereto and examined in more detail below, through which process air flows in the direction of the arrows indicated in FIG. 1.

The process air flow arrangement comprises a series of process air channels LU1, LU2, LU3 and LU4 and devices connected to these, specifically a blower GB, a heating device HE and an evaporator EV of a condenser device (not illustrated in detail). The evaporator EV is connected here on the outlet side by way of a funnel-shaped connector TR1 serving as a transition piece to the one end of the process air channel LU1, to which cold, dry process air is supplied and which is connected at its other end to an input connector of the blower GB. This blower GB is connected on the output side by way of the process air channel LU2 to the input side of the heating device HE, which is connected on the output side by the process air channel LU3 to the input side of the washing or laundry drum WT for the supply of now hot, dry process air. On the output side, the washing or laundry drum WT is connected by the process air channel LU4 and a funnel-shaped connector TR2 also serving as a transition piece and connected thereto to the inlet side of the evaporator EV for the discharge of hot, moist process air, which is extracted from damp laundry to be dried in said washing or laundry drum WT. Condensation of the moisture from the hot, moist process air supplied by the process air channel LU4 from the washing or laundry drum WT takes place in this evaporator EV. The condensate water occurring as a result in the evaporator EV enters a condensate water trough KW disposed below the evaporator EV in the form of water droplets as shown in FIG. 1 and is collected there.

The condensate water collected in the condensate water trough KW must now be removed therefrom, so that it does not overflow. To this end in the present instance the condensate water trough KW is connected by a connecting channel K1 to the input side of an electric pump P1, which can be an impeller pump for example. On the output side the pump P1 is connected by a connecting channel K2 to the input side of a distributor VE, which in the present instance may be a controllable two-way valve. The relevant distributor or two-way valve VE has two output connectors, one of which is connected to a connecting channel K3 and the other of which is connected to a connecting channel K4.

The connecting channel K3 serves to ensure that condensate water pumped up from the condensate water trough KW by means of the pump P1 and dispensed through it is dispensed into a separate storage tank SP1 provided in the upper region of the washer dryer or tumble dryer containing the device. This storage tank SP1 can be for example a storage tank that can be removed manually from the washer dryer or tumble dryer in which the described device is contained, which can be used to dispose of the condensate water pumped up into it from the condensate water trough KW.

The connecting channel K4 serves to dispense condensate water supplied to it from the distributor or two-way valve VE to a rinse tank SB1 on the output side. This rinse tank SB1 which is disposed in the washer dryer or tumble dryer containing the illustrated device as far as possible on the upper side of said dryer and which can feature the same storage capacity as the condensate water trough KW or the storage tank SP1, for example to hold 2.5 liters of condensate water, is provided for safety reasons—as illustrated—with an overflow arrangement, through which condensate water that may overflow from the rinse tank SB1 reaches an overflow tank UB, which is connected by a backflow channel RK directly to the condensate water trough KW and is able to dispense condensate water reaching it directly to the condensate water trough KW.

The condensate water collected in the condensate water trough KW can on the other hand be pumped away through a connecting channel K5 by means of an electric pump P2, which can also be an impeller pump, into a connecting channel K6, which may lead to a waste water disposal arrangement and to a water discharge line.

The output or outlet side of the rinse tank SB1 is connected by way of a normally closed closure part VT1, which is to be opened by actuation or activation, to a downpipe FR. This downpipe FR, which has a relatively large cross section, preferably has a length determining a drop height of around 500 mm to 600 mm for the condensate water to be dispensed in a surge in each instance from the rinse tank SB1. It is provided at its lower end in FIG. 1 with a rinse nozzle DU featuring a roughly oval outlet region with a width of around 6 mm to 10 mm extending over the entire width of the evaporator EV and disposed in a fixed position, said rinse nozzle DU being disposed with the longitudinal center of its outlet region at a set distance, here around 10 mm to 50 mm, from the inlet region of the evaporator EV for hot, moist process air on the right in FIG. 1. This arrangement of downpipe FR and rinse nozzle DU allows condensate water exiting from the rinse tank SB1 when the closure part VT1 is opened to be dispensed as a surge of water to an evaporator region preferably located only at the set distance from the inlet region of the process air into the evaporator EV. The dimensions of the passage opening of the closure part VT1 and the cross section of the downpipe FR and the rinse nozzle DU are preferably selected so that the condensate water collected in the rinse tank SB1—in other words around 2.5 liters of condensate water according to the example assumed above—is dispensed within a very short time interval of 1 to 2 seconds as a surge of water to the evaporator EV. The dispensing of such a surge of water, in other words at a speed of at least 2.5 liters in 2 seconds and preferably immediately after a drying process has been carried out for the damp laundry in the washing or laundry drum WT, makes it possible particularly effectively to rinse lint and other impurities that have been carried there by the process air channel LU4 and the funnel-shaped connector TR2 out of the abovementioned process air inlet region of the evaporator EV and over said region.

To achieve a largely regular dispensed quantity for the surge of water between the start and end of dispensing it has proven expedient for the downpipe FR to feature a region with which the rinse nozzle DU is also associated, which is narrower than the cross section of the outlet region of the rinse tank SB1. It should however be ensured here that the previously indicated minimum quantity of condensate water per unit of time is provided to rinse the evaporator EV.

In addition to the abovementioned dispensing in a surge of the condensate water contained in each instance in the rinse tank SB1 to the evaporator EV, it is also possible for normal pressurized mains water to be dispensed for cleaning purposes. To this end a water supply pipe WA is provided, to which the relevant pressurized mains water is supplied. A closure part VT2 is connected to the dispensing side of the relevant water supply pipe WA according to FIG. 1, it being possible for said closure part VT2 to be a normal check valve for example. On the outlet side of the closure part VT2 a water discharge pipe ZR is provided, projecting into the downpipe FR in the latter's lower region, in other words according to FIG. 1 above the rinse nozzle DU of the relevant downpipe FR. This allows the mains water to be dispensed in addition to the surge of condensate water dispensed from the rinse tank SB1 to clean the evaporator EV or it can also be dispensed alone to the evaporator EV to clean it. To prevent the condensate water trough KW overflowing in this process, the condensate water collected in each instance in the rinse tank SB1 can be pumped away with the aid of the abovementioned pumps P1 and P2. It is evident here that only the portion of condensate water collected in each instance in the condensate water trough KW 1 that corresponds to the capacity of the rinse tank SB1 and/or the storage tank SP1 should be pumped away by means of the pump P1. The further portion of condensate water dispensed to the condensate water trough KW has to be pumped away by means of the pump P2 into the abovementioned discharge arrangement.

This in particular additional dispensing of mains water to clean the evaporator EV allows said evaporator EV to be cleaned quite excellently. The relevant dispensing of mains water to clean the evaporator EV is of particular significance in a washer dryer, which has a mains water supply device and a mains water discharge device in any case. A combined dispensing of pressurized mains water and the condensate water dispensed in a surge from the rinse tank SB1 allows even more efficient cleaning of the evaporator EV to be achieved than with the sole dispensing of mains water or condensate water to said evaporator EV.

The first embodiment of the device illustrated in FIG. 1 can however also be used in a tumble dryer, in which only damp laundry is to be dried. In this instance the tumble dryer in question—which normally does not have connections to a water supply and a water discharge—has to be supplied with mains water in the water supply pipe WA, in other words it has to be connected to a corresponding mains water connector and also the connecting channel K6 illustrated in FIG. 1 has to be connected to a waste water discharge arrangement. The same conditions are then present in a tumble dryer for the cleaning of the evaporator EV with condensate water from the rinse tank SB1 and in some instances mains water as were explained above with reference to a washer dryer.

A control device ST is provided to control the various devices illustrated in FIG. 1, as mentioned above. This control device ST can comprise for example a microcontroller with its own software or a microprocessor controller with a CPU, a ROM containing an operating program and a working program and a working memory RAM as well as interface circuits to which actuation signals are supplied on the input side and which allow control signals to be output to the various devices of the device illustrated in FIG. 1 on the output side.

According to FIG. 1 for example the control device ST has two input connectors E1 and E2, to which switches S1 and S2 respectively are connected, each of which are present at a voltage connector U, which is able to carry a voltage of +5V for example. On the output side the control device ST has for example eight output connectors A0, A1, A2, A3, A4*a*, A4*b*, A5*a* and A6 in the present instance.

The output connector A0 is connected to a control input of the pump P2, the operation of which allows condensate water collected in the condensate water trough KW to be pumped away through the connecting channels K5 and K6 to a waste water receiver, and to a discharge pipe.

The output connector A1 of the control device ST is connected to a control input of the blower GB, which can be switched on or off by control signals supplied to it at this control input.

The output connector A2 of the control device ST is connected to a corresponding control input of the heating device HE, which can be switched on or off by control signals supplied to this control input.

The output connector A3 of the control device ST is connected by way of a connection simply to be understood as an active connection to the washing or laundry drum WT, which can be made to rotate or stopped by means of control signals output by way of the relevant connection. This means that the relevant control signals are output from the output connector A3 of the control device ST to an electric drive motor connected to the washing or laundry drum WT.

The output connector A4*a* of the control device ST is connected to an actuation input of the closure part VT2 which is either closed or completely opened by control signals supplied to it from the output connector A4*a* of the control device ST. It is however also possible for the closure part VT2, which as mentioned above can preferably be an electrically actuated closing valve, normally to be closed and only to be completely opened by a control signal (e.g. corresponding to a binary signal "1") output from the output connector A4*b* of the control device ST.

The output connector A4*b* of the control device ST is connected to an actuation input of the closure part VT, which is which is either closed or completely opened by control signals supplied to it from the output connector A4*b* of the control device ST. It is however also possible for the closure part VT normally to be closed and only to be completely opened by a control signal (e.g. corresponding to a binary signal "1") output from the output connector A4 of the control device ST.

The output connector A5 of the control device ST is connected to a control or actuation input of the distributor or two-way valve VE. Control signals output by way of this connection to the closure part or two-way valve VE allow the relevant closure part or two-way valve VE to dispense condensate water supplied to it from the condensate water trough KW by means of the pump P1 either to the connecting channel K3 or to the connecting channel K4 or to block such dispensing to both connecting channels K3 and K4.

The output connector A6 of the control device ST is connected to a control input of the abovementioned pump P1, which can be made to start pumping or be stopped further to control signals supplied to it by this connection.

It should be noted in relation to the control device ST considered above with its input connectors E1 and E2 and output connectors A0 to A6 that closing the switch S1 connected to the input connector E1 of the control device ST for example causes the normal drying operation for damp laundry in the washing or laundry drum WT to be initiated and performed and closing the switch S2 connected to the input connector E2 of the control device ST causes the dispensing of condensate water from the suddenly opened rinse tank SB1 as a surge of water to the evaporator EV to be controlled. It may be possible here for the actuation of the two switches S1 and S2 only to be performed in such a manner that only one of the two switches S1 and S2 can be actuated in each instance. The relevant switches S1 and S2 can also be formed in each instance by a push button.

The provision of the condensate water in the rinse tank SB1 from the condensate water trough KW can take place for example automatically by means of program control preferably during a drying operation or at the end of such or specifically by manual intervention in the program control of the washer dryer or tumble dryer containing the described device. In the event of such manual intervention in the program control, the control device ST could be connected by means of a further input by way of a further switch (not shown) to the voltage connector U. The dispensing in the manner of a surge of the condensate water contained in the rinse tank to the evaporator EV after the end of the drying process causes lint and other impurities adhering to the fins LA (see FIG. 3) of said evaporator EV to be rinse off easily by the relatively high flow speed and the relatively large quantity of condensate water. This rinsing process can optionally be repeated once or more with the condensate water in question. To this end the condensate water collecting again in each instance in the condensate water trough KW has to be pumped up into the rinse tank SB1, from which it is then dispensed again in the manner of a surge to the evaporator. At the end of the cleaning or rinsing process the condensate water that has collected in the condensate water trough KW should either be discharged into an available waste water system or be pumped into the rinse tank SB2, which then has to be emptied manually.

As well as the rinsing process considered above such a rinsing process and therefore cleaning of the evaporator EV can take place by means of pressurized mains water, which is supplied to the relevant evaporator EV by way of the water supply pipe WA, the closure part VT2 and the water discharge pipe ZR. In this instance the control device ST, as an alternative or in addition to outputting a control signal that opens the closure part VT1, outputs a corresponding control signal to the closure part VT2 to open it.

Figure 2A:
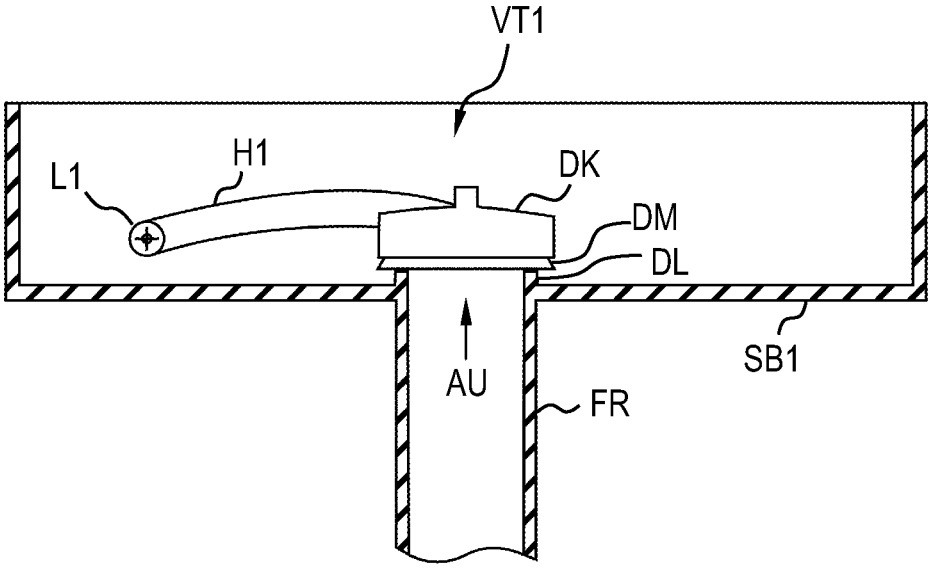
FIG. 2A shows an enlarged diagram and partial section of a rinse tank provided in the device according to FIG. 1.

FIG. 2A shows an enlarged and more detailed sectional diagram of the rinse tank SB1 shown schematically in FIG. 1 with its closure part VT1 in the closed position. The closure part VT1 only shown schematically in FIG. 1 is formed according to FIG. 2 in that the rinse tank SB1 features sealing regions or sealing lips DL around an outlet opening AU in the region of the downpipe FR connected to it, on which sealing regions or sealing lips DL the lower face of a sealing head DK rests in a sealing manner when the closure part is in the closed state. This sealing head DK has a sealing sleeve DM on its lower face, said sealing sleeve DM ensuring the closing off of the outlet opening AU or downpipe FR from the rinse tank SB1 when the sealing head DK is in position. The sealing head DK is connected to a first lever arm H1. The sealing head DK and first lever arm H1 are preferably produced as a single piece, e.g. made of plastic by means of an injection molding method. The first lever arm H1 is supported rotatably on opposing side walls of the rinse tank SB1. The lifting of the sealing head DK off and lowering onto the outlet opening AU is therefore associated with a pivot movement of the first lever 1. To open the closure part VT1 from its closing base position, a force (in the form of a linear force component or a torque) is applied to the lever arm H1, as described in more detail below. Opening the closure part VT1 allows the condensate water contained in the rinse tank SB1 to be dispensed as a surge of water through the downpipe FR and the rinse nozzle DU to the evaporator EV according to FIG. 1.

Figure 2B:
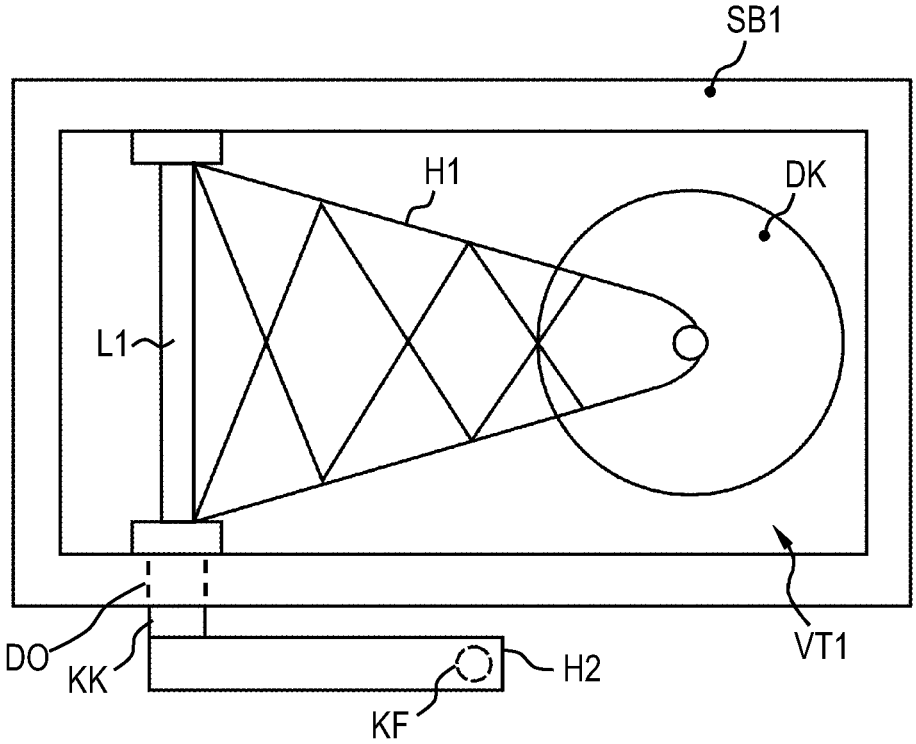
FIG. 2B shows the rinse tank according to FIG. 2A with an associated closure part viewed from above.

FIG. 2B shows the rinse tank SB1 viewed from above. The plate-shaped sealing head DK is connected at the top and edge to the first lever arm H1. The lever arm H1 has a strut-type structure to reduce its weight whilst remaining extremely rigid and this transitions at the end opposite the sealing head DK into a shaft serving as a lever axle L1. The shaft L1 is supported rotatably in opposing positions on the side wall of the rinse tank SB1. On one side, here the lower side, a through opening D0 is provided in the side wall of the rinse tank SB1, through which the first lever arm H1 is connected mechanically by way of a coded claw coupling KK to a second lever arm H2 positioned on the outside of the rinse tank SB1. A sealing element DC, e.g. an O ring or V ring, is positioned either on the inner lever H1 or on the outer lever H2 and seals the lever construction VT1 off from the rinse tank SB1, so that no water can pass from the inside out. A control unit for actuating the closure part VT1 is positioned on a contact surface KF on the lower face of the second, outer lever arm H2, as described below.

Figure 3:
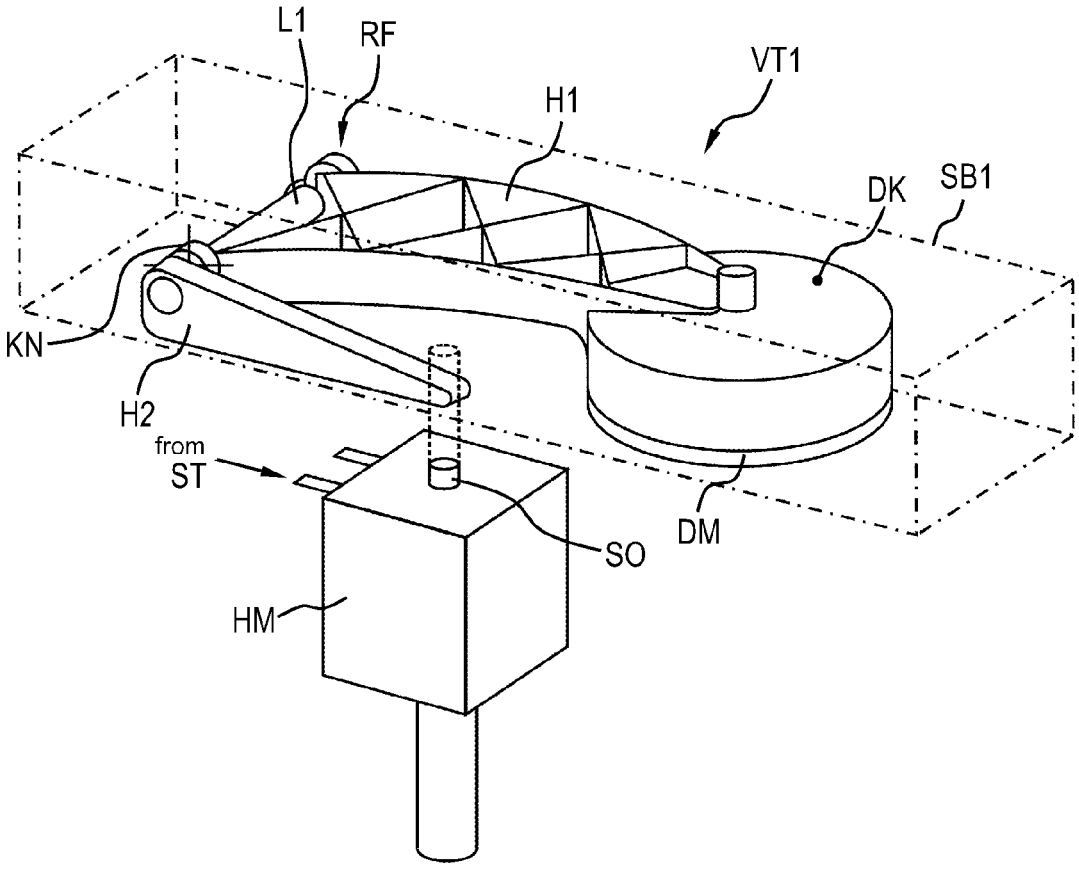
FIG. 3 shows the rinse tank according to FIG. 1 viewed obliquely with the associated closure part and an actuator actuating the closure part.

FIG. 3 shows a view through the rinse tank SB1 shown with a broken line. To open the closure part VT1 and therefore to lift the sealing head DK from the outlet opening a lifting magnet HM is activated by means of a control signal from the control device ST, so that it moves a plunger SO out in an upward direction, which after an initial free run makes contact or engages with the lower contact surface KF of the outer lever arm H2 (see FIG. 2B) and pushes it up. The rotational movement of the second lever arm H2 serving as the force arm is transmitted by way of the claw coupling KK to the first lever arm H1 serving as the load arm, which then rotates in the same direction, thereby lifting the sealing head DK. This allows any water present in the rinse tank SB1 to surge out into the downpipe. To close the sealing head DK the lifting magnet is deactivated again, so that it retracts its plunger SO, whereupon the sealing head DK is pressed back onto the outlet opening AU by its own weight and the inherent weight of the first lever arm H1. To close the sealing head DK off reliably, a return spring RF, which is only shown in outline here and which presses the first lever arm H1 onto the outlet opening, is located on the shaft L1.

The use of a lifting magnet HM is particularly suitable for the valve opening actuation system shown. It can be connected to a mains voltage of 110 or 230 VAC for example, with no need for a separate mains component. Also the use of a simple rectifier, e.g. a bridge rectifier, means that the lifting magnet can also be used in a direct current configuration, which opens up the possible of noise damping which is not possible with a purely alternating current lifting magnet. Impact noise between the pole core and armature can then be significantly reduced in the lifting magnet operating using direct current for example by damping plates between the armature and pole core. A lifting magnet HM also has a fast opening time (typically around 100-400 ms), which is advantageous because the rinsing effect/water surge is largely due to the kinetic energy of the water present in the rinse tank SB1. However this energy can only be used effectively if the sealing head DK rises sufficiently quickly. The lifting magnet HM per se is also much less expensive than servomotors.

In contrast to other lever constructions the closure part VT1 shown has the further advantage that the actuator is positioned externally in relation to the rinse tank SB1. With an—essentially possible—positioning of the actuator HM in the rinse tank SPB 1 disadvantageously (a) the actuator HM would have to be designed to be sealed against water and moisture, (b) electric contacting would have to be established by way of complex sliding contacts and (c) the actuator would take up a large volume of the tank SB1, thereby reducing the effective rinse water volume.

In addition to the speed of the actuator HM the opening cross section to the downpipe also plays a major role, in other words for the sealing head not only to open quickly enough but also wide enough. Because of the small space available the lifting magnet HM has a certain disadvantage here, as the force/path characteristic curve becomes less favorable with lifting paths greater than approx. 15 mm. In other words the opening path and opening force at the sealing head DK must be tailored to one another. The opening force (force required to lift the sealing head) is made up for example of the spring force of the return spring RF, the static water column above the sealing head DK and sliding and adhesion friction forces. These requirements can be tailored to one another and implemented most effectively by way of a lever construction, in particular by means of the lever construction shown with the first, inner lever arm H1 and the second, outer lever arm H2, as explained below with reference to FIG. 4.

Figure 4:
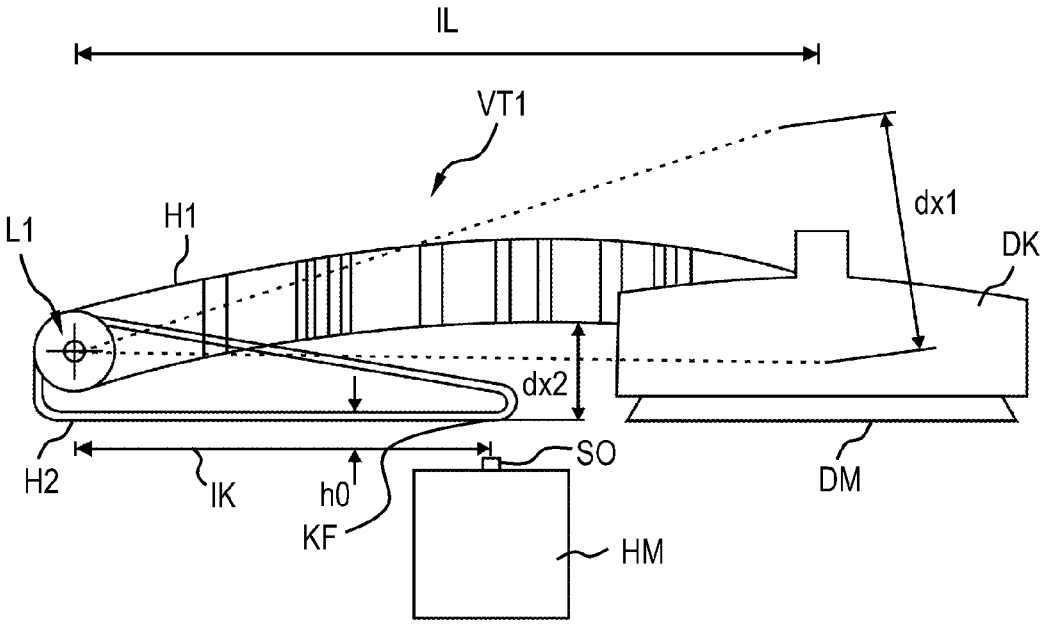
FIG. 4 shows a side view of the closure part.

FIG. 4 shows a side view of the closure part VT1 without the rinse tank. The effective load arm IL of the lever arm H1 between the lever axle L1 and the center of the sealing head DK is 115 mm in the exemplary embodiment shown. The effective force arm IK of the lever arm H2 between the lever axle L1 and the contact surface with the plunger SO of the lifting magnet HM is 65 mm. The plunger SO must bridge a free lift h0 of 4 mm between its retracted base state and contact with the second lever H2 at the contact surface. The maximum lift d×2 applied by the lifting magnet HM used here to the second lever H2 is 21 mm. The effective arms IK, IL of different lengths produce a maximum lift d×1 at the first lever arm H1 of approx. 37 mm, which roughly reflects the length ratio IL/IK, with geometric corrections not being taken into account for the purposes of a simple description. Use of the lever-assisted closure part VT1 allows the disadvantage of the lifting magnet HM, specifically its non-optimum force/path characteristic curve, to be eliminated for longer lifting paths and at the same time allows a structurally advantageous position of the actuator HM outside the rinse tank to be realized. Generally a compact, fast switching closure part VT1 results that is simple to fit and opens wide.

Figure 5A:
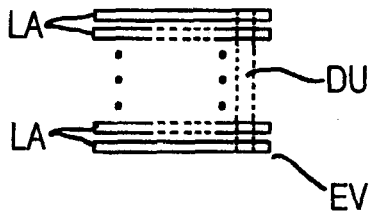
FIG. 5A shows a schematic diagram of an evaporator of a condenser device, as provided in the device illustrated in FIG. 1, viewed from above.

FIG. 5A shows a schematic diagram of the evaporator EV in the device shown in FIG. 1 viewed from above. It can be seen from FIG. 5A that the evaporator EV consists of a series of parallel fins LA. These fins LA are formed by metal plates, which are cooled in the abovementioned condenser device in such a manner that moisture from the moist process air supplied to them from the right side in FIG. 5A is deposited on the cold surfaces of the fins LA and gives rise, as shown in FIG. 1, to the dispensing of condensate water and/or mains water to the condensate water trough KW shown there. FIG. 5A shows the fixed position of the rinse nozzle DU in relation to the evaporator EV.

Figure 5B:
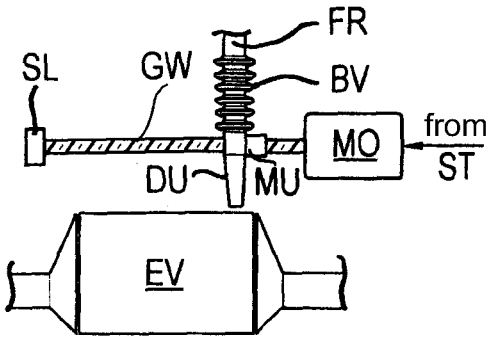
FIG. 5B shows an arrangement by means of which the condensate water dispensed in a surge from the rinse tank in the device according to FIG. 1 can be dispensed over a definable region of the evaporator of the condenser device.

While with the evaporator EV illustrated in FIGS. 1 and 5A the rinse nozzle DU is disposed in a fixed position in relation to the evaporator EV in each instance, FIG. 5B shows a device in which the rinse nozzle DU can be moved in relation to the evaporator EV, or more specifically deflected. According to FIG. 5B a drive device is provided above the evaporator EV of the abovementioned condenser device, consisting of an electric motor MO that can be controlled by the control device ST, a threaded spindle GW that can be rotated by said electric motor MO and a nut part MU coupled to said threaded spindle GW, connected in the present instance to the rinse nozzle DU. The threaded spindle GW is supported at its end away from the motor MO by a support bearing SL, as shown in FIG. 5B.

According to FIG. 5B the rinse nozzle DU is connected to the downpipe FR by a movable connecting part BV, which can be formed for example by a bellows part or a corrugated hose. The fact that the rinse nozzle DU can be moved in relation to the evaporator EV means that the rinse nozzle DU can be deflected during the dispensing of a surge of water and/or mains water from an initial region at the inlet region of the process air into the evaporator EV of the condenser device to an end region at a distance therefrom in the direction of the outlet region of the process air out of the evaporator EV. In other words the fins LA of the evaporator EV according to FIG. 5A can be rinsed by means of the condensate water dispensed in a surge through the downpipe FR and the rinse nozzle DU and/or mains water over a set length, for example over their entire length.

It should also be noted that the dispensing in the manner of a surge as described above of the condensate water passing through the downpipe FR and the rinse nozzle DU and/or mains water from an initial region at the inlet region of the process air into the evaporator EV of the condenser device to an end region at a distance therefrom in the direction of the outlet region of the process air out of the evaporator EV can also be effected by deflecting the downpipe FR correspondingly together with the rinse nozzle DU. The abovementioned deflection can also take place in a manner different from the one shown in FIG. 5B, in other words generally by means of a mechanically, hydraulically, pneumatically or electromechanically actuated deflection device.

Figure 6:
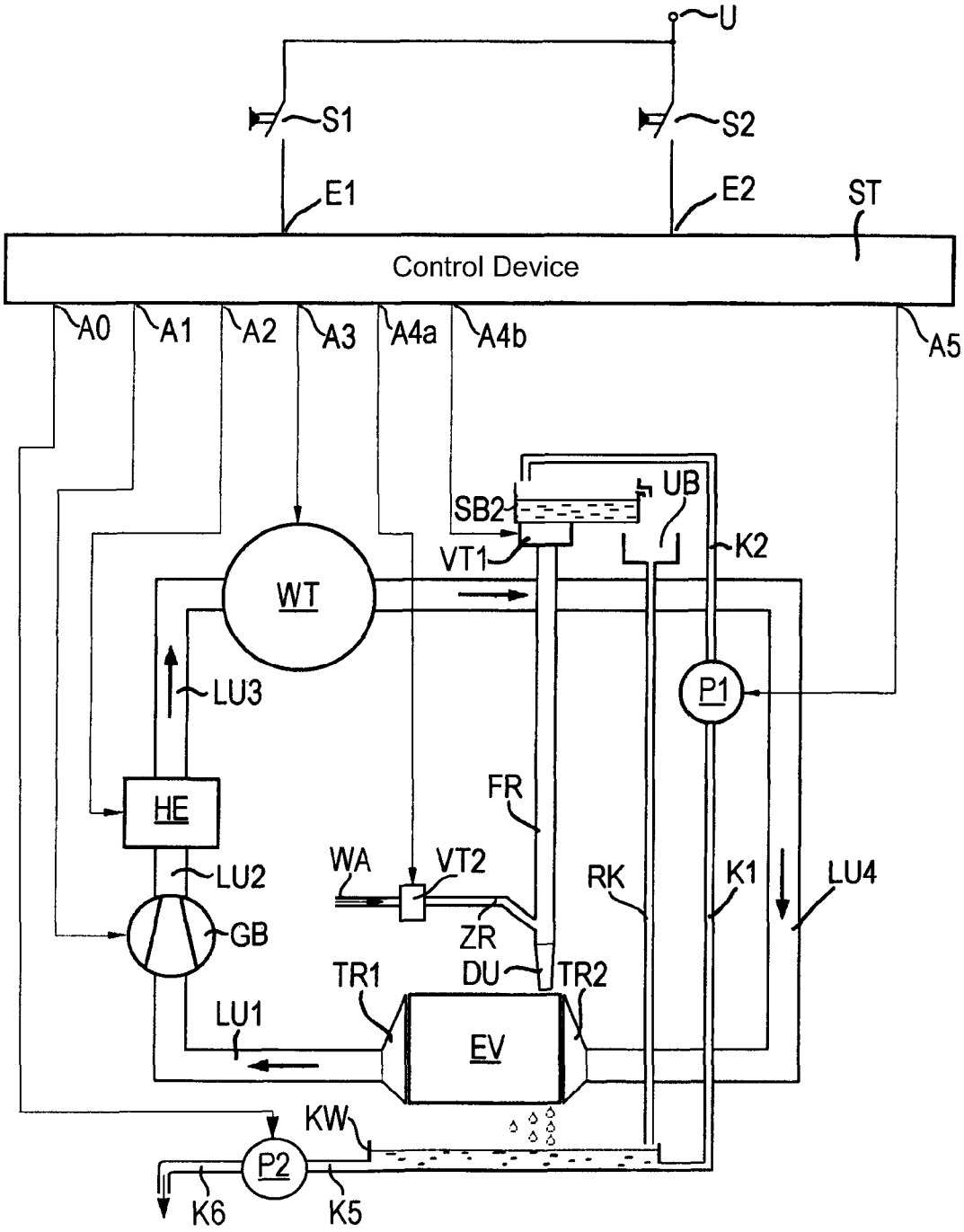
FIG. 6 shows a schematic diagram of a device according to a second embodiment.

The device according to the second exemplary embodiment shown in FIG. 6 in a schematic diagram corresponding to the one used for FIG. 1 is now considered. Since the device shown in FIG. 6 largely corresponds to the device shown in FIG. 1, only those features by which said devices differs from the device shown in FIG. 1 will be described in detail.

The apparatus according to the second exemplary embodiment shown in FIG. 6 differs from the device shown in FIG. 1 essentially in that the storage tank SP1 provided in the device according to FIG. 1 has been dispensed with, its function being taken over by the rinse tank SB2. When the rinse tank SB2 is full of condensate water, in this instance as with the device in FIG. 1, for safety reasons further condensate water supplied to it is fed back into the return channel RK and thus directly into the condensate water trough KW by an overflow arrangement UB.

Condensate water collecting in the rinse tank SB2 can be dispensed by sudden opening of the closure part VT1 as a surge of water to the downpipe to clean the evaporator EV, as with the rinse tank provided in the device according to FIG. 1.

Like the storage tank SP1 in the device shown in FIG. 1 the rinse tank SB2 can be a manually removable rinse tank SB2, by means of which it is possible to dispose of the condensate water pumped up into it from the condensate water trough KW. The disposal of the condensate water from the rinse tank SB2 can be effected by removing the rinse tank SB2 in question completely from the washer dryer or tumble dryer and emptying it into a waste water discharge device. Such emptying can take place manually. However it is also possible for the condensate water contained in the rinse tank SB2 to be pumped away by means of an electrically actuated pump and discharged into the abovementioned waste water discharge device.

Figure 7:
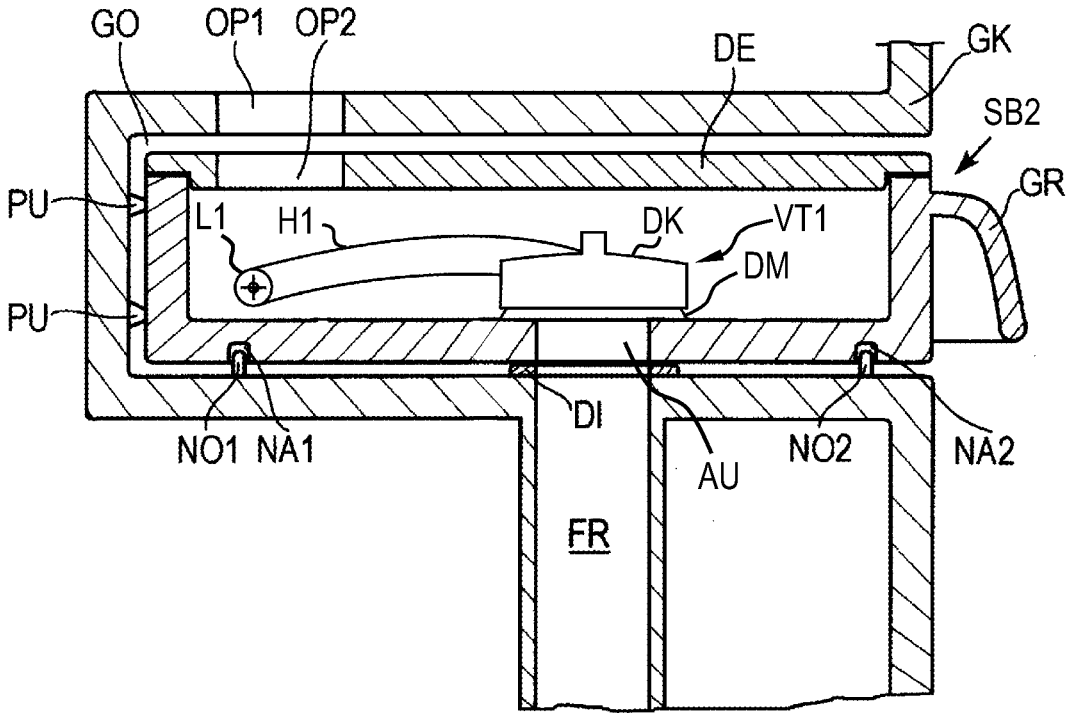
FIG. 7 shows an enlarged diagram and partial section of a rinse tank provided in the device according to FIG. 1, containing condensate water, inserted into an appliance body and largely closed off at the top by a cover.
Figure 8:
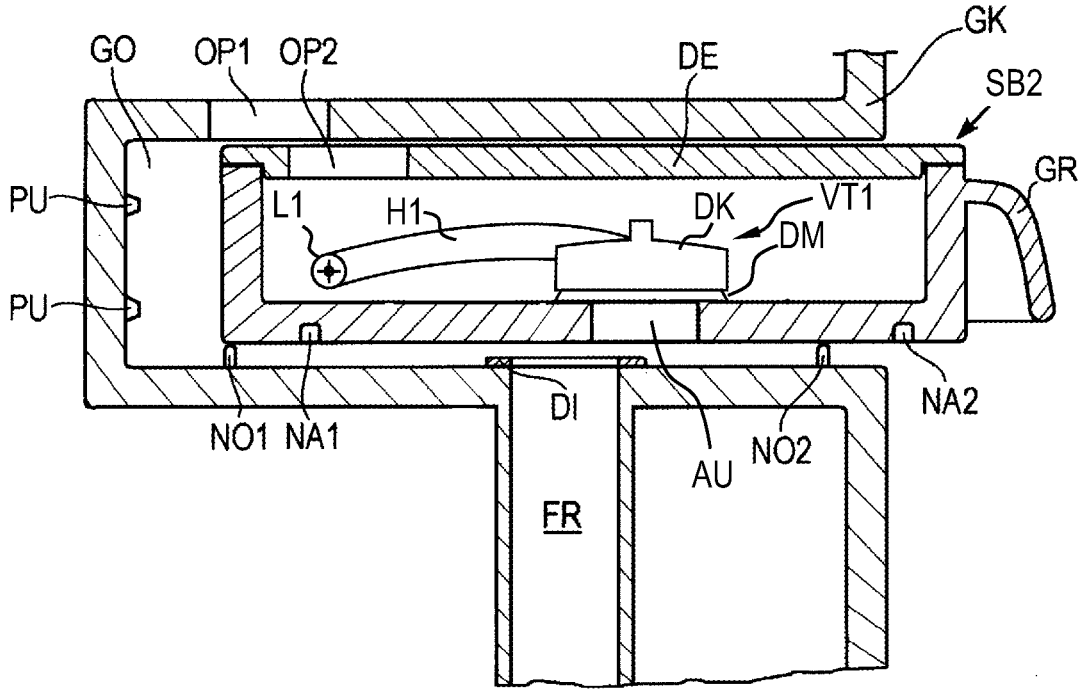
FIG. 8 shows an enlarged diagram of the rinse tank illustrated in FIG. 7 in a state where it is partially withdrawn from the abovementioned appliance body.

FIGS. 7 and 8 show more details of possible embodiments of the rinse tank SB2 shown only schematically in FIG. 6. FIGS. 7 and 8 show a sectional diagram of the rinse tank SB2 as a cuboid receiving unit, the top of which is covered by a cover DE. This cover DE can be connected to the receiving unit in question for example by means of a snap-fit connecting arrangement. At its end shown on the right in FIGS. 7 and 8 the receiving unit in question of the rinse tank SB2 features a handle GR, which can be used to insert the rinse tank SB2 into a corresponding receiving opening GO of an appliance body GK of the washer dryer or tumble dryer, said receiving opening GO also serving as a guide device for the rinse tank SB2. FIG. 7 shows the rinse tank SB2 in a state in which it is inserted completely into the receiving opening GO of the appliance body GK and FIG. 8 shows the situation where the rinse tank SB2 is withdrawn to some degree from said receiving opening GO of the appliance body GK.

When inserted into said receiving opening GO the rinse tank SB2 rests with its end region shown on the left in FIG. 7 against buffers PU which project from the inside of the receiving opening GO receiving the rinse tank SB2. In this state the rinse tank SB2 is held by cams NO1 and NO2 respectively, which project from the lower face of the relevant receiving opening GO, by means of cam holders NA1 and NA2 provided in its lower face. In this state the rinse tank SB2 is lowered in relation the lower face of the abovementioned receiving opening GO of the appliance body GK and therefore rests on the lower face of the abovementioned receiving opening GO in a sealing manner due to a sealing element in the form of a sealing disk DI. Therefore moist process air that may rise up in the downpipe FR can neither enter the rinse tank SB2 nor reach the outside of the appliance body GK. In this state the outlet opening AU in the lower region of the rinse tank SB2 is also closed off by the closure part VT1, as in the embodiment according to FIG. 2A, with the closure part VT1 here also being able to rest in a sealing manner on sealing regions or lips projecting from the lower inner face of the rinse tank.

When the rinse tank SB2 is withdrawn from the abovementioned receiving opening GO by means of the handle GR, the lower face of the rinse tank SB2 slides over the cams NO1 and NO2 thereby preventing any damage to or erosion of the sealing disk DI, as shown in FIG. 8.

In the position of the rinse tank SB2 shown in FIG. 7 two through openings OP1 and OP2 are aligned with one another, the through opening OP1 being provided in the rear region of the abovementioned receiving opening GO of the appliance body GK and the through opening OP2 being provided in the corresponding region of the cover DE of the rinse tank SB2. These aligned through openings, which are preferably of the same size, allow condensate water to be introduced into the rinse tank SB2 through the connecting channel K2 illustrated in FIG. 6.

The sealing head DK of the closure part VT1 illustrated in FIGS. 7 and 8 is supported by the lever arm D1, which is held side walls of the rinse tank SB2 in such a manner that the rinse tank SB2 and the closure part VT1 (with which the two lever arms H1 and H2 but not the lifting magnet HM are associated) can be moved relative to the abovementioned receiving opening GO.

Figure 9:
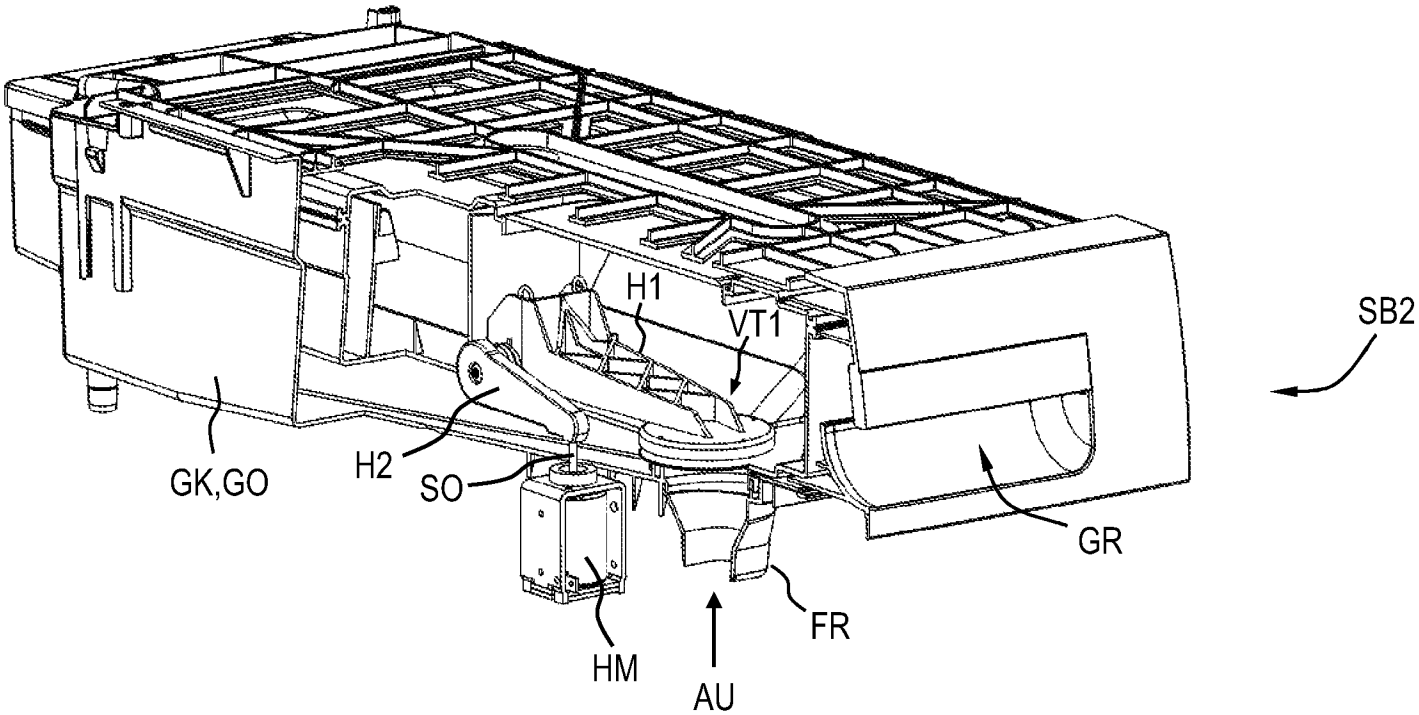
FIG. 9 shows an oblique view of a partial section of the rinse tank shown in FIGS. 7 and 8, as inserted into a possible guide device

FIG. 9 shows a part of the appliance body GK forming the guide unit GO. The rinse tank SB2 is inserted into the guide unit GO. The rinse tank SB2 can be withdrawn from the guide unit GO using the handle GR. The lifting magnet HM is disposed on an outer face of the part of the appliance body GK forming the guide unit GO, its plunger SO being guided through a passage (not shown in detail) in a lower tray US of the guide unit GO in a sealed manner to make contact with the lower face of the outer lever H2 of the closure part VT1.

Figure 10:
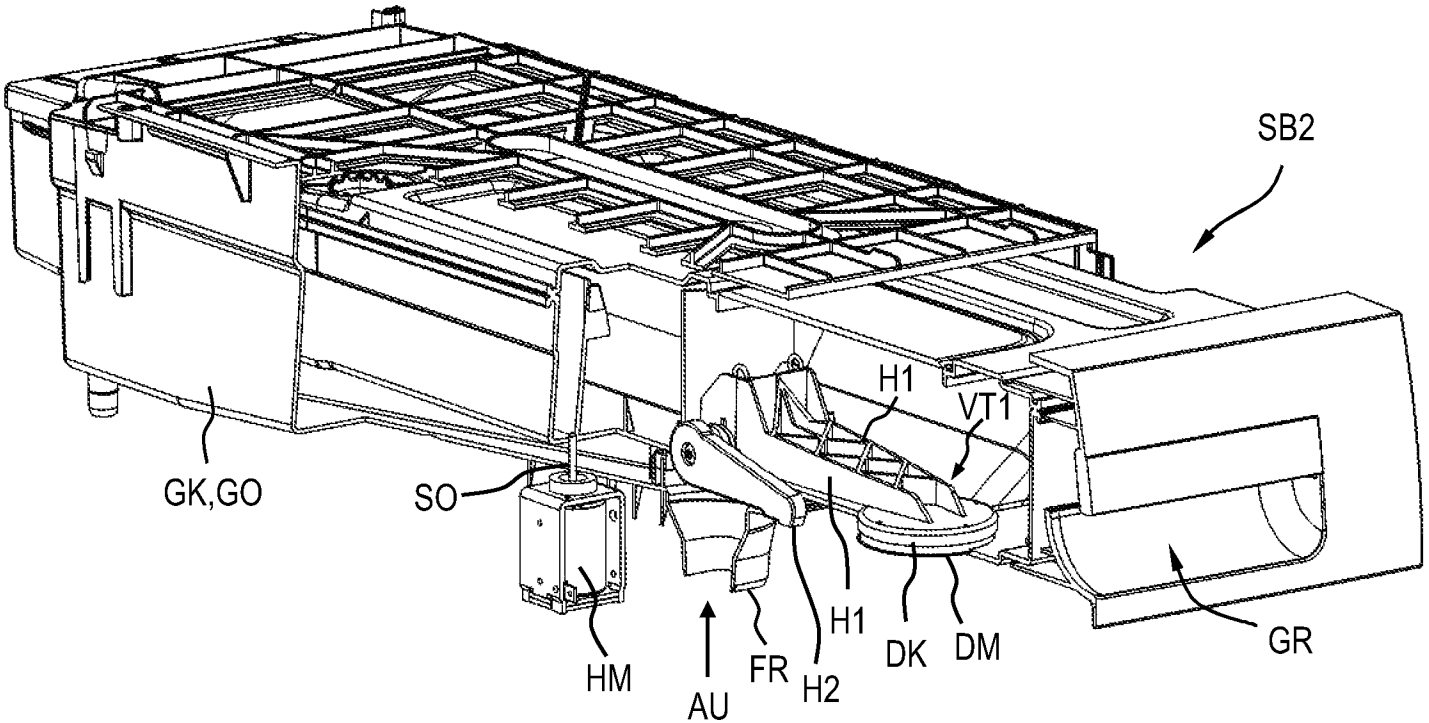
FIG. 10 shows the rinse tank from FIG. 9 in a partially withdrawn state.

FIG. 10 shows an identical view of the device from FIG. 9 but with the rinse tank SB2 now withdrawn to some degree from the guide unit GO. The closure part VT1 is carried along with the rinse tank SB2 and thus separated from the lifting magnet HM and plunger SO. The return spring (not shown) ensures that the outlet opening closes irrespective of the position of the rinse tank SB2. The rinse tank SB2 can thus be removed from the dryer and handled by a user, e.g. to empty out condensate, without there being a risk of the outlet opening AU being opened inadvertently. When the rinse tank SB2 is inserted the rounded rear face of the outer lever H2 means that the plunger SO slides below the outer lever H2 if it comes into the path of the lever H2.

The invention described above is not restricted to the embodiments shown in the drawing and their description.

Thus a reinforced lift piezo actuator or a fast servo motor can be used instead of a lifting magnet.

Also if a separate storage tank is dispensed with, the rinse tank can be divided into two chambers, specifically a rinse chamber and a collecting chamber, being divided by a partition or intermediate wall. The condensate water pumped up out of the condensate water trough by the pump then reaches the rinse chamber first for example through the connecting channel. Since the height of the partition wall is somewhat lower than the height of the peripheral regions of the rinse tank, which represents a combination or combi tank, the rinse chamber is filled with condensate water our of the condensate water trough first. When the rinse chamber is full of condensate water, further condensate water supplied to it overflows into the collecting chamber. When the collecting chamber is full, water is removed therefrom by way of the overflow UB.

LIST OF REFERENCE CHARACTERS

A0, A1, A2, A3, A4*a*, A4*b*, A5, A6 Output connectors
AB1, AB2 Lowered regions
AU Outlet opening
BE Actuation device
BV Movable connecting part
DC Sealing element
DE Cover
DI Sealing element or disk
DK Sealing head
DL Sealing regions or lips
DM Sealing sleeve
DO Through opening
DU Rinse nozzle
d×1 Maximum lift at first lever arm
d×2 Maximum lift at second lever arm
E1, E2 Input connectors
EL Inlet region
EV Evaporator
FB Guide path
FR Downpipe
FS Guide pin or roller
FU Guide rail
GB Blower
GK Appliance body
GO Receiving opening
GR Handle
GW Threaded spindle
H0 Free lift
H1 First lever arm (inner lever)
H2 Second lever arm (outer lever)
HE Heating device
HM Lifting magnet
K1, K2, K3, K4, K5, K6 Connecting channels
KF Contact surface
KK Claw coupling
KW Condensate water trough
LA Fins
IK Effective force arm
IL Effective load arm
LU1, LU2, LU3, LU4 Process air channels
MO Electric motor, motor
MU Nut part
NA1, NA2 Cam holder
N01, NO2 Cam
OP1, OP2 Opening
P1, P2 Pump
PU Buffer
RF Return spring
RK Backflow channel
S1, S2 Switch
SB1 Rinse tank
SB2 Rinse tank
SO Plunger
SP1 Storage tank
SL Support bearing
ST Control device
TE Closure plate
TL Bearing part
TR1, TR2 Funnel-shaped connectors (transition parts)
TT, TT1 Support part
TT2 Actuation pin
U Voltage connector
UB Overflow tank
US Lower tray
VE Distributor or two-way valve
VT1, VT2 Closure part
WA Water supply pipe
WT Washing or laundry drum
ZR Water discharge pipe

The invention claimed is:

1. A device, comprising:

a component to be cleaned, the component configured to be located within a process air circuit of the device;

a condensate water trough configured to collect condensate water formed in the process air circuit as a result of drying damp laundry;

a rinse tank positioned above the component and having an outlet opening;

a first lever arm rotatably fastened to the rinse tank, a second lever arm positioned outside of the rinse tank and coupled to the first lever arm, and a sealing head connected to the first lever arm and configured to close the outlet opening; and an actuator configured to actuate the second lever arm to selectively open and close the outlet opening, wherein the device is configured to conduct the condensate water from the condensate water trough to the rinse tank, wherein the sealing head is configured to be opened to dispense the condensate water from the outlet opening of the rinse tank onto the component, wherein the rinse tank is removable from the device such that the first lever arm, the second lever arm, and the sealing head are removable with the rinse tank, and wherein the actuator is fastened on a receiving opening configured to guide the rinse tank.

2. The device of claim 1, wherein the component is an evaporator of a condenser.

3. The device of claim 1, wherein the actuator is set up and disposed to apply a force to the second lever arm.

4. The device of claim 1, wherein the actuator has a lifting magnet.

5. The device of claim 1, wherein the actuator further comprises a plunger, said plunger configured to apply a lifting movement to the second lever arm.

6. The device of claim 1, wherein a lifting path of the actuator has a maximum travel of 30 mm.

7. The device of claim 6, wherein the maximum travel is 25 mm.

8. The device of claim 1, wherein the actuator is configured to travel through a lifting path in less than 2 seconds.

9. The device of claim 8, wherein the actuator is configured to travel through a lifting path in less than 0.5 seconds.

10. The device of claim 9, wherein the actuator is configured to travel through a lifting path in less than 0.2 seconds.

11. The device of claim 1, further comprising a claw coupling to couple the first lever arm and the second lever arm.

12. The device of claim 1, further comprising a sealing element configured to seal a through opening between the first and second lever arms.

13. The device of claim 1, further comprising a spring element configured to press the sealing head onto the outlet opening.

14. The device of claim 1, wherein the device is one of a washer dryer and a tumble dryer.

15. The device of claim 1, wherein the first lever arm is rigidly connected to the sealing head.

16. The device of claim 13, wherein the spring element is configured to apply a rotational force to the first lever arm.

17. The device of claim 13, further comprising a shaft, wherein the first lever arm is rotatable about the shaft, and the spring element is located on the shaft.

18. The device of claim 1, wherein the device is adapted to deliver between 75 and 150 liters per minute of the condensate water to the component.

19. The device of claim 18, wherein the device is adapted to fully dispense the condensate water within two seconds.

20. The device of claim 1, wherein the first lever arm is rotatably fastened to the rinse tank such that the outlet opening remains closed by the sealing head when the rinse tank is removed from the device.

21. A method for operating a device having a component to be cleaned, said component located within a process air circuit of the device; a condensate water trough configured to collect condensate water formed in the process air circuit as a result of drying damp laundry; a rinse tank positioned above the component and having an outlet opening; a first lever arm rotatably fastened to the rinse tank, a second lever arm positioned outside of the rinse tank and coupled to the first lever arm, and a sealing head connected to the first lever arm and configured to close the outlet opening; and an actuator configured to actuate the second lever arm to selectively open and close the outlet opening; wherein the device is configured to conduct the condensate water from the condensate water trough to the rinse tank, the method comprising:

actuating the actuator to apply a force to the second lever arm to open the outlet opening; and lifting the sealing head from the outlet opening by the first lever arm as a result of the actuator applying the force to the second lever arm to dispense the condensate water from the outlet opening of the rinse tank onto the component, wherein the rinse tank is removable from the device such that the first lever arm, the second lever arm, and the sealing head are removable with the rinse tank, and wherein the actuator is fastened on a receiving opening configured to guide the rinse tank.

22. The method of claim 21, wherein the first lever arm is rotatably fastened to the rinse tank such that the outlet opening remains closed by the sealing head when the rinse tank is removed from the device.

23. The method of claim 21, wherein the device is one of a washer dryer and a tumble dryer.

24. A laundry appliance comprising:

a process air circuit;

a condensate water trough configured to collect condensate water formed in the process air circuit;

a component to be cleaned, the component being positioned within the process air circuit;

a rinse tank positioned above the component, the rinse tank includes an outlet opening and being adapted to store water;

a first lever arm rotatably fastened to the rinse tank, a second lever arm positioned outside of the rinse tank and coupled to the first lever arm, and a sealing head connected to the first lever arm and configured to close the outlet opening; and an actuator configured to actuate the second lever arm to selectively open and close the outlet opening, wherein the sealing head is configured to be opened to dispense the water from the fluid outlet opening of the rinse onto the component, wherein the rinse tank is removable from the laundry appliance such that the first lever arm, the second lever arm, and the sealing head are removable with the rinse tank, wherein the laundry appliance is configured to conduct the condensate water from the condensate water trough to the rinse tank, and wherein the actuator is fastened on a receiving opening configured to guide the rinse tank.

25. The laundry appliance according to claim 24, wherein the outlet opening is adapted to deliver the water with a flow rate between 75 and 150 liters per minute.

26. The laundry appliance according to claim 25, wherein the rinse tank is adapted to store 2.5 liters of water.

27. The laundry appliance according to claim 24, wherein the rinse tank is adapted to completely dispense the water stored therein within two seconds when the rinse tank is full.

28. The laundry appliance according to claim 24, wherein the component is an evaporator of a condenser.

29. The laundry appliance according to claim 24, wherein the actuator is set up and disposed to apply a force to the second lever arm.

30. The laundry appliance according to claim 24, wherein the actuator has a lifting magnet.

31. The laundry appliance according to claim 24, wherein the actuator further comprises a plunger, said plunger configured to apply a lifting movement to the second lever arm.

32. The laundry appliance according to claim 24, further comprising a claw coupling to couple the first lever arm and the second lever arm.

33. The laundry appliance according to claim 24, further comprising a sealing element configured to seal a through opening between the first and second lever arms.

34. The laundry appliance according to claim 24, further comprising a spring element configured to press the sealing head onto the outlet opening.

35. The laundry appliance according to claim 24, wherein the first lever arm is rotatably fastened to the rinse tank such that the outlet opening remains closed by the sealing head when the rinse tank is removed from the laundry appliance.

36. The laundry appliance of claim 24, wherein the laundry appliance is one of a washer dryer and a tumble dryer.

* * * * *